US011414256B2

(12) United States Patent
Fabela

(10) Patent No.: US 11,414,256 B2
(45) Date of Patent: Aug. 16, 2022

(54) ALL PURPOSE COOLER WITH TABLETOP

(71) Applicant: MIL-STD Designs, LLC, San Antonio, TX (US)

(72) Inventor: Herman Fabela, Buda, TX (US)

(73) Assignee: MIL-STD Designs, LLC, San Antonio, TX (US)

( * ) Notice: Subject to any disclaimer, the term of this patent is extended or adjusted under 35 U.S.C. 154(b) by 0 days.

(21) Appl. No.: 17/225,453

(22) Filed: Apr. 8, 2021

(65) Prior Publication Data

US 2021/0316934 A1 Oct. 14, 2021

Related U.S. Application Data

(60) Provisional application No. 63/008,189, filed on Apr. 10, 2020.

(51) Int. Cl.
*B65D 81/38* (2006.01)
*B65D 43/16* (2006.01)

(52) U.S. Cl.
CPC ..... *B65D 81/3813* (2013.01); *B65D 43/164* (2013.01)

(58) Field of Classification Search
CPC ..... B65F 1/1431; B25H 3/00; B25H 3/06; B65D 81/3813; B65D 43/164
USPC ..... 220/908
See application file for complete search history.

(56) References Cited

U.S. PATENT DOCUMENTS

| | | | | |
|---|---|---|---|---|
| 3,979,007 | A * | 9/1976 | Thornbloom, Jr. | A45C 11/20 220/522 |
| 4,024,731 | A | 5/1977 | Branscum | |
| 4,276,955 | A * | 7/1981 | Hickman | A47C 12/00 269/244 |
| 5,551,558 | A * | 9/1996 | Bureau | A45C 9/00 190/11 |
| 6,311,991 | B1 * | 11/2001 | Conrado | A45C 5/14 280/47.26 |
| 9,834,342 | B2 | 12/2017 | Seiders | |
| 2017/0313492 | A1 | 11/2017 | Seiders et al. | |
| 2018/0015938 | A1 * | 1/2018 | DeFrancia | B62B 5/067 |
| 2018/0141718 | A1 * | 5/2018 | Ahlstrom | B65D 25/2841 |

* cited by examiner

*Primary Examiner* — Shawn M Braden
(74) *Attorney, Agent, or Firm* — Gary Stanford; Huffman Law Group, PC

(57) ABSTRACT

A cooler including a main body, a lid, and a tabletop. The main body includes an interior cavity and an upper circumference when the main body is in an upright position. The lid and the tabletop are both pivotally attached to the main body. The lid has a closed position for covering the upper circumference of the main body to enclose the interior cavity forming an insulating container. The tabletop has an opened position to form a horizontal surface for placing and supporting objects when the main body is in the upright position.

20 Claims, 11 Drawing Sheets

ALL PURPOSE COOLER WITH TABLETOP

CROSS REFERENCE TO RELATED APPLICATION(S)

This application claims the benefit of U.S. Provisional Application Ser. No. 63/008,189, filed on Apr. 10, 2020, which is hereby incorporated by reference in its entirety for all intents and purposes.

BACKGROUND OF THE INVENTION

Field of the Invention

The present invention relates in general to ice chest type coolers, and more particularly to an all-purpose cooler including a separate tabletop pivotally attached to a cooler body.

Description of the Related Art

Many types of ice-chests or coolers are known. Most conventional coolers have limited functionality and are primarily configured for storing cold beverages and preserving food at lower temperatures than the surrounding ambient air.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
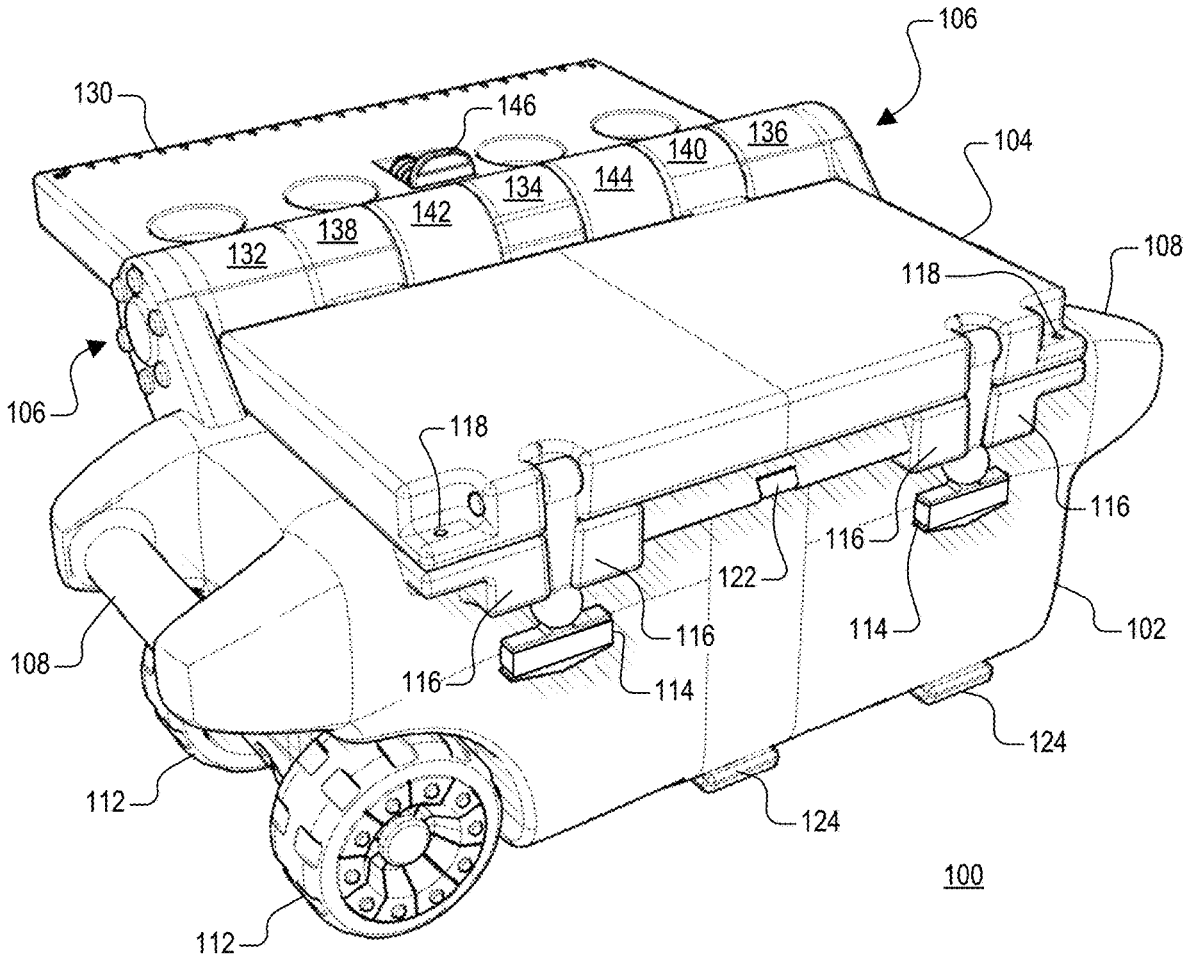
FIG. 1 is a front perspective view of a cooler implemented according to one embodiment of the present disclosure shown in an upright position.

FIG. 1 is a front perspective view of a cooler 100 implemented according to one embodiment of the present disclosure shown in an upright position. The cooler 100 is an ergonomically designed ice chest for storing cold beverages and preserving food at lower temperatures compared to the surrounding ambient air. In the illustrated embodiment, the cooler 100 includes a main body 102, a lid 104 pivotally coupled to the main body 102 with a hinge assembly 106, handles 108 integrally formed on upper portions of both left and right sides of the main body 102, a towing handle 110 (FIG. 2) rotatably mounted to the handle 108 on the right-side of the main body 103, and a pair of rotatable wheels 112 mounted on the lower portion of the left side of the main body 102. It is noted that the terms "left" and "right" are used only for convenience of reference when facing a front end of the cooler 100. One or more lid locks 114 are provided along a front edge of the lid 104 that are aligned to be inserted into corresponding slots 115 (FIG. 3) formed within protruding structures 116 along the top and front edge of the main body 102 for securing the lid 104 when in the illustrated closed position.

The lid locks 114 may be made of a flexible material, such as rubber or the like, which are each stretched and inserted into the slots 115 when the lid 104 is in the closed position for securing the lid 104 to the main body 102. Alternatively, the lid locks 114 may be rigid and pivotally mounted and rotated and inserted into the corresponding slots 115 for securing the lid 104 when closed position.

In one embodiment, the main body 102 and the lid 104 form an insulating container that may be made with thermoplastic roto-molded construction using thermal insulation materials such as food-grade UV-resistant polyethylene materials. In one embodiment, the thermal insulation materials may include polyurethane. In one embodiment, the main body 102 and the lid 104 may be made with. The main body 102 and the lid 104 may be roto-molded and injected with expanded foam to provide hours of ice retention when the lid 104 is in the closed position as shown in FIG. 1. Generally, the main body 102 forms an insulated container having an interior cavity 304 (FIG. 3) and an upper circumference 902 (FIG. 9) at a top area of the main body 102, in which the lid 104 covers the upper circumference 902 when in the closed position to enclose the interior cavity 304.

Additional features may be included. Pad lockable holes 118 may be formed on the lid 104 aligned in the closed position with corresponding pad lockable holes 120 (FIG. 3) formed in the protruding structures 116 of the main body 102 to secure the contents if desired. A bottle opener 122 may be formed on the upper lip of the front end of the main body 102 to enable the removal of metal bottle caps from glass bottles. Elevated structural footing 124 may be formed on the lower end of the main body 102 designed to support and carry heavy loads.

The cooler 100 further includes a tabletop 130 pivotally coupled to the main body 102 via the hinge assembly 106. The tabletop 130 is shown in a fully opened position so that it is effectively parallel with the lid 104 when the lid 104 is in the fully closed position as shown in FIG. 1. In one embodiment, the tabletop 130 has an upper surface 203 (FIG. 2) that may be coplanar with an upper surface 502 (FIG. 5) of the lid 104 when the lid 104 is closed and the tabletop 130 is opened. In one embodiment, the tabletop 130 pivotally mounted to the main body 102 using additional portions of the same hinge assembly 106 used to pivotally mount the lid 104 as further described herein.

The hinge assembly 106 is positioned along a back edge 904 (FIG. 9) of the upper circumference 902 of a top area of the main body 102 in the illustrated embodiment. As further described herein, the hinge assembly 106 is configured to enable pivotal movement of the lid 104 between opened and closed positions (shown in the closed position in FIG. 1) and also to enable pivotal movement of the tabletop 130 between opened and closed positions (shown in the opened position in FIG. 1). In the illustrated configuration, the hinge assembly 106 includes three cylindrically shaped hinges integrally formed with the main body 102, including a left hinge 132 located at a left-most position along the back edge 904, a middle hinge 134 located in the middle position along the back edge 904, and a right hinge 136 located at a right-most position along the back edge 904. The left and right hinges 132 and 136 are outer hinges and the middle hinge 134 is positioned between the outer hinges.

The illustrated hinge assembly 106 further includes two cylindrically shaped hinges integrally formed with the lid 104, including a left hinge 138 positioned adjacent the left hinge 132 of the main body 102, and a right hinge 140 positioned adjacent the right hinge 136 of the main body 102. The illustrated hinge assembly 106 further includes two cylindrically shaped hinges integrally formed with the tabletop 130, including a left hinge 142 positioned between the left hinge 138 (of the lid 104) and the middle hinge 134 (of the main body 102), and a right hinge 144 positioned between the middle hinge 134 (of the main body 102) and the right hinge 140 (of the lid 104). The tabletop 130 includes a tabletop latch 146 mounted within an opening 202 (FIG. 2) of the body of the tabletop 130, in which the latch 146 is manipulated between an unlocked position for allowing movement of the tabletop 130 and a locked position to lock the tabletop 130 in either its closed position or its opened position as further described herein.

Figure 2:
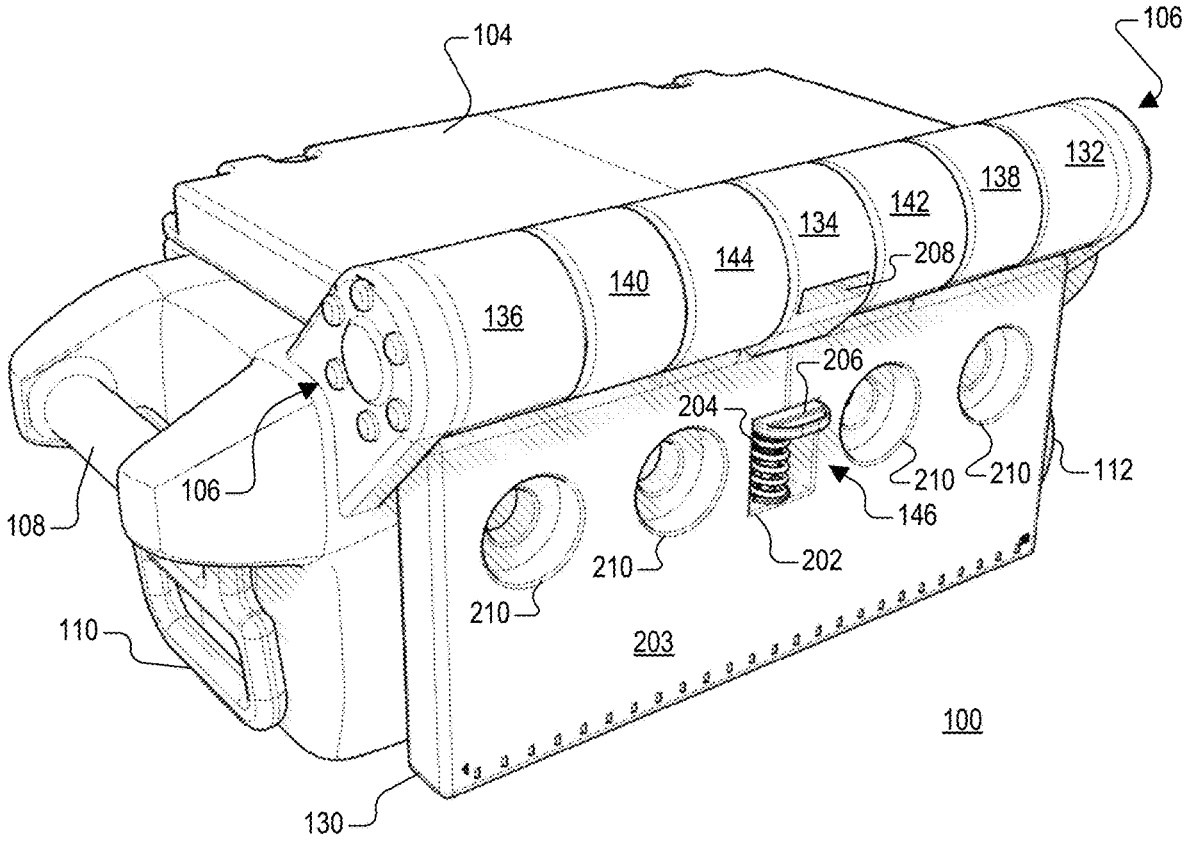
FIG. 2 is a rear perspective view of the cooler of FIG. 1 in the upright position with the lid and the tabletop both in their closed positions according to one embodiment of the present disclosure.

FIG. 2 is a rear perspective view of the cooler 100 in the upright position with the lid 104 and the tabletop 130 both in their closed positions according to one embodiment of the present disclosure. The towing handle 110 is shown in its closed position, but may be grasped (e.g., by the hand) and pulled upwards to rotate to an extended position (not shown) to allow towing of the cooler 100 using the wheels 112 located on the lower left side of the main body 102. The wheels 112 may be implemented as a rubber tire and plastic or metal wheel system capable of navigating on all types of terrain (grass, dirt, sand, concrete, asphalt, rocks, etc.) when the cooler 100 is being towed using the towing handle 110. Although two wheels 112 are shown, alternative configurations may include any number of wheels including a single wheel or three or more wheels. A single, larger wheel may be used instead, or even 3 or more wheels aligned with each other or distributed across a bottom surface of the main body 102.

The cylindrically-shaped hinges 132, 134, 136, 138, 140, 142, and 144 of the hinge assembly 106 are shown aligned along the back edge 904 of the main body 102 in the illustrated embodiment. The opening 202 is formed along the upper surface 203 of the tabletop 130 and recessed within the body of the tabletop 130 into which the tabletop latch 146 is installed. In the illustrated embodiment, the tabletop latch 146 is a spring-loaded latch system including a latch spring 204 and a latch handle 206 protruding above the surface 203, in which the latch handle 206 is shown in a locked position to secure the tabletop 130 in the closed position. The latch handle 206 may be slid to an unlocked position compressing the latch spring 204 to allow the tabletop 130 to be moved to and secured in the opened position as shown in FIG. 1. As further described herein, the handle 206 of the tabletop latch 146 is integrally formed with a locking extension 1202 (FIG. 12) that protrudes from an opening along a front edge of the tabletop 130 when the handle 206 is in the locked position. The locking extension 1202 slides into one of multiple slots formed along an outer cylindrical surface of the middle hinge 134 as further described herein. As shown, a slot 208 is formed within a body of the middle hinge 134 for receiving the locking extension 1202 to hold the tabletop 130 in its opened position (see, e.g., FIG. 8).

Figure 6:
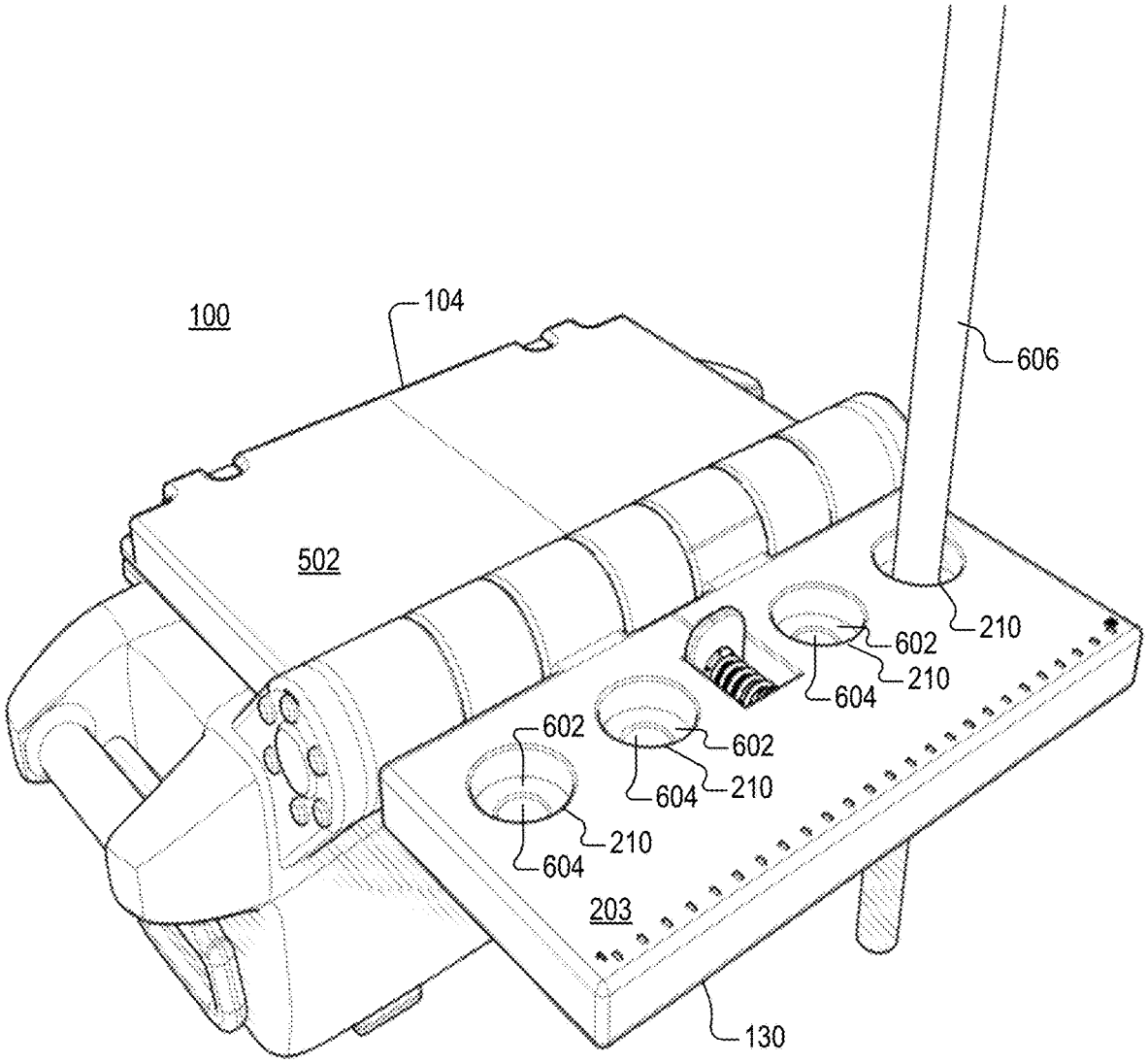
FIG. 6 is another rear perspective view of the cooler of FIG. 1 in its upright position with the lid closed and the tabletop opened according to one embodiment of the present disclosure.

The tabletop 130 may include one or more cupholders 210 that are distributed along the surface 203, each formed as circular holes or openings with a suitable diameter that extend to a suitable depth within the body of the tabletop 130 to facilitate receiving and holding a bottle, glass, or cup, or the like when the tabletop 130 is in its opened position as shown in FIG. 6, described herein below.

Figure 3:
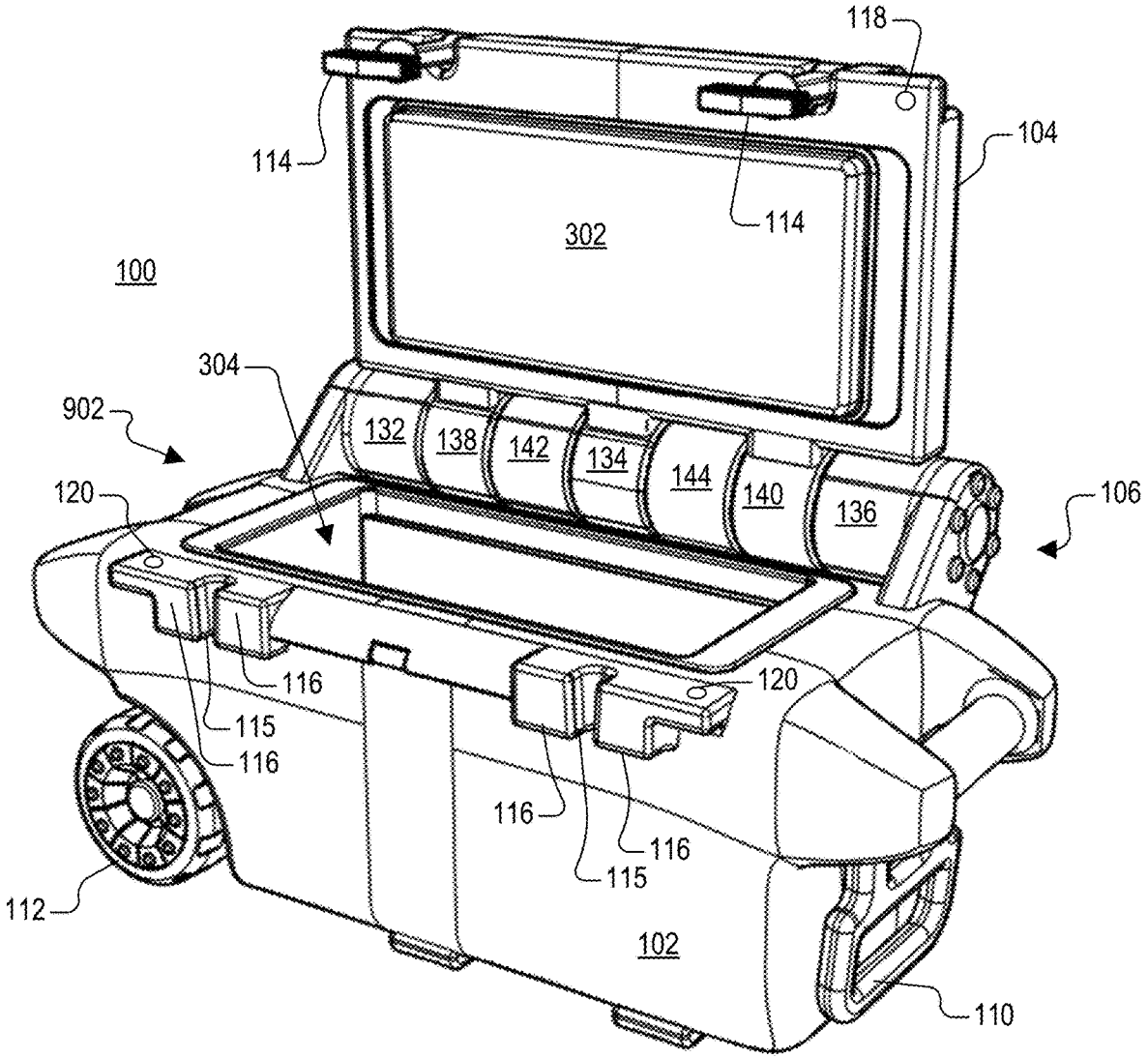
FIG. 3 is another front perspective view of the cooler of FIG. 1 illustrating the lid in a fully opened and vertical position relative to a main body of the cooler in its upright position according to one embodiment of the present disclosure.

FIG. 3 is another front perspective view of the cooler 100 illustrating the lid 104 in a fully opened and vertical position relative to the main body 102 in its upright position according to one embodiment of the present disclosure. The lid locks 114 have been pulled out of the corresponding slots 115 formed within the protruding structures 116 to unlock the lid 104 and enable the lid 104 to be rotated from the closed position to the fully opened position. A lower surface 302 of the lid 104 is configured to form a seal with an upper circumference 902 of the main body 102 when in the closed position, as further described herein. In the illustrated embodiment, the upper circumference 902 generally has a rectangular shape with a rectangular-shaped edge, in which the rectangular edge formed by front, back, left, and right substantially straight edges. Also shown is the interior cavity 304 of the main body 102 for receiving and storing cold beverages and preserving food at lower temperatures compared to the surrounding ambient air. Also shown are the pad lockable holes 120 formed in the protruding structures 116 of the main body 102 that are aligned with the corresponding pad lockable holes 118 formed on the lid 104. A padlock or the like may be inserted into the holes 118/120 that are aligned with each other when the lid 104 is closed to secure the contents if desired.

The cylindrically-shaped hinges 132, 134, 136, 138, 140, 142, and 144 of the hinge assembly 106 are shown aligned along the back edge 904 of the upper circumference 902 of the main body 102. As previously described, the left and right hinges 138 and 140 are integrally formed on the lid 104 and aligned with the other hinges of the hinge assembly 106 for pivotal or rotational movement of the lid 104 between its closed and opened positions. The wheels 112 and the towing handle 110 are shown at the left and right sides, respectively, of the main body 102 to facilitate easy towing of the cooler 100 as previously described.

Figure 4:
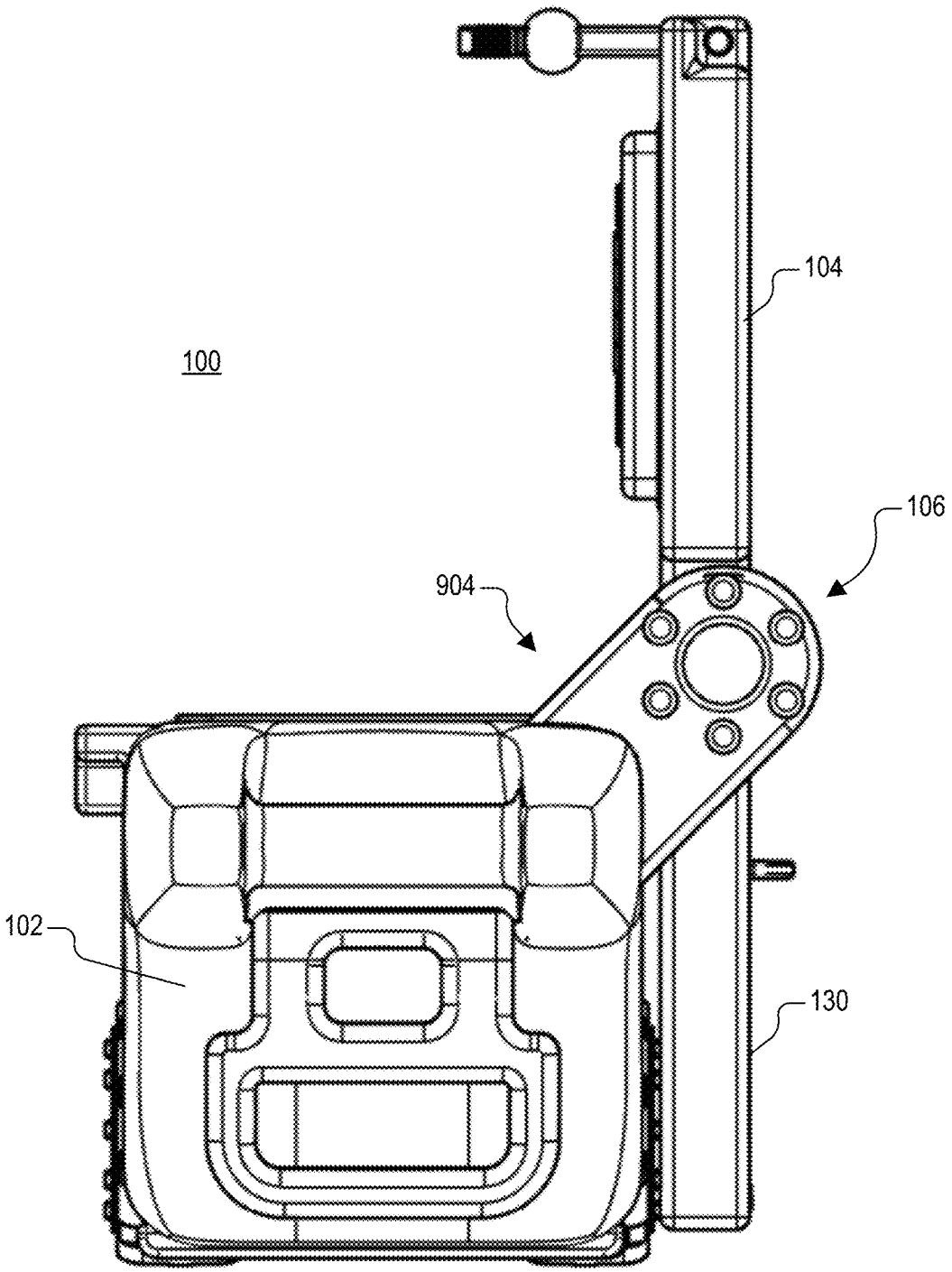
FIG. 4 is an orthogonal right-side view of the cooler of FIG. 1 in its upright position with the lid fully opened and the tabletop fully closed according to one embodiment of the present disclosure.

FIG. 4 is an orthogonal right-side view of the cooler 100 in its upright position with the lid 104 fully opened and the tabletop 130 fully closed according to one embodiment of the present disclosure. The lid 104 and the tabletop 130 are aligned in the vertical direction relative to the hinge assembly 106. The hinge assembly 106 is externally positioned along the back edge 904 of the main body 102 and protrudes sufficient to enable such vertical alignment of the lid 104 and the tabletop 130.

Figure 5:
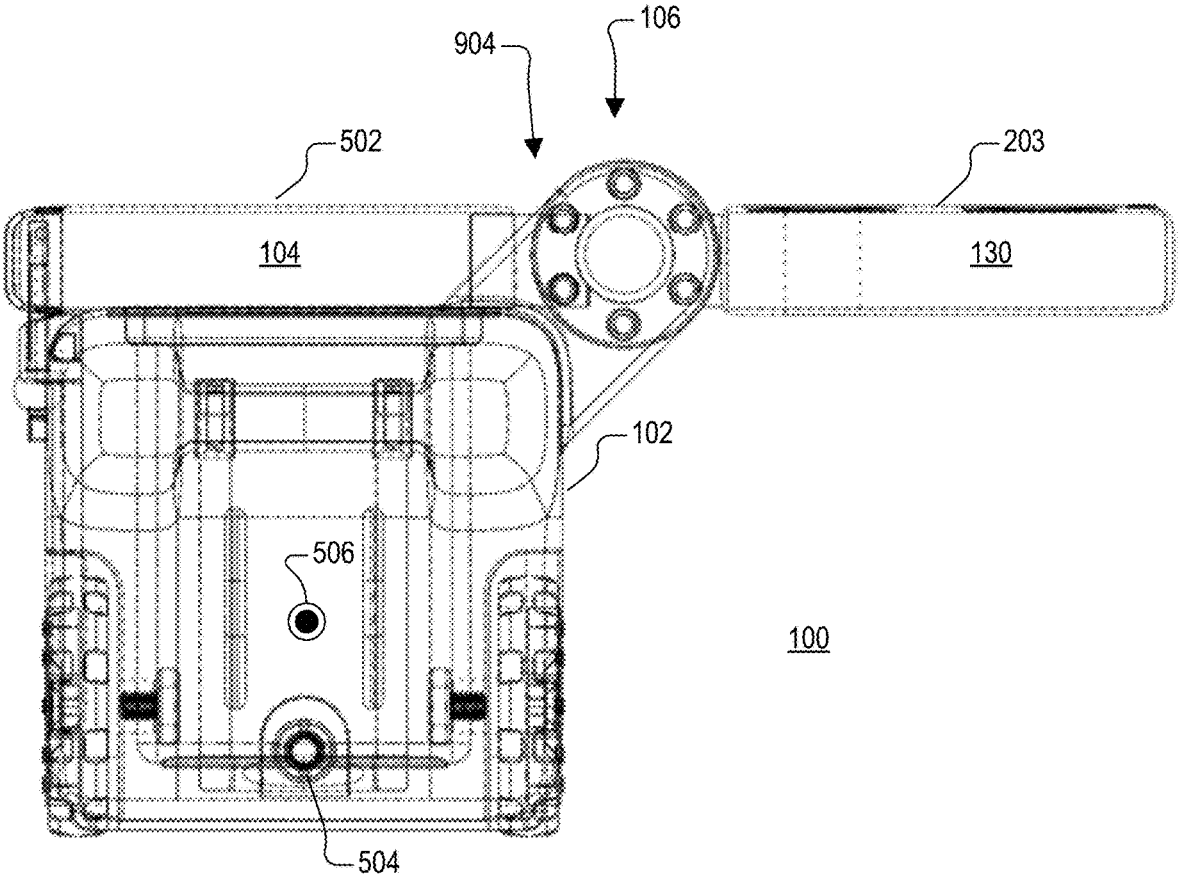
FIG. 5 is an orthogonal left-side transparent view of the cooler of FIG. 1 in its upright position with the lid closed and the tabletop opened according to one embodiment of the present disclosure.

FIG. 5 is an orthogonal left-side transparent view of the cooler 100 in its upright position with the lid 104 closed and the tabletop 130 opened according to one embodiment of the present disclosure. The lid 104 and the tabletop 130 are aligned in the horizontal direction relative to the hinge assembly 106. The hinge assembly 106 is externally positioned along the back edge 904 of the main body 102 and protrudes sufficient to enable such horizontal alignment of the lid 104 and the tabletop 130. In this case, the upper surface 203 of the tabletop 130 and an upper surface 502 of the lid 104 are coplanar with respect to each other essentially forming an extended upper surface of the cooler 100 when in the upright position.

Also shown is a drain plug 504 that is screwed into a corresponding drain hole (not shown) that is provided between the exterior and the interior cavity 304 of the main body 102. The drain plug 504 is configured to unscrew from the drain hole to allow melted ice-water or the like to drain from the interior cavity 304 of the main body 102. In addition, a pressure relief valve 506 may be mounted to or formed on the main body 102, such as above the drain plug 504 as shown. As the ambient temperature increases, so does the pressure. The temperature of the interior cavity 304 of the cooler 100 remains lower than the outside or ambient temperature, especially over time as the lid 104 remains closed and locked. The temperature differential causes a corresponding pressure differential. Thus, the pressure difference between the inside and outside of the cooler 100 may make the lid 104 difficult to open and may, in some cases, seal it shut. The pressure release valve 506 may include a rubber button or the like that when pushed releases air that reduces the pressure differential to allow the lid 104 to be opened without difficulty.

FIG. 6 is another rear perspective view of the cooler 100 in its upright position with the lid 104 closed and the tabletop 130 opened according to one embodiment of the present disclosure. Each of the cupholders 210 has a bottom surface 602 for supporting an object placed therein, such as a bottle, glass, or cup or the like. In addition, one or more up to all of the bottom surfaces 602 of the cupholders 210 may further include a hole 604 with a smaller diameter than the cupholders 210 and that extends all the way through the body of the tabletop 130. Each hole 604 allows fluid drainage, and may further be configured to allow a pole 606 to be inserted therein, such as part of an umbrella, a flagpole, or a fishing pole or the like. In an alternative embodiment, a supporting member (not shown) mounted to the pole 606 that is larger than the hole 604 and positioned below the hole 604 so that the pole 606 may serve as a support leg for the tabletop 130. FIG. 6 also illustrates how the upper surface 203 of the tabletop 130 essentially extends the upper surface 502 of the lid 104 to create a larger overall upper surface when the cooler 100 is in its upright position.

Figure 7:
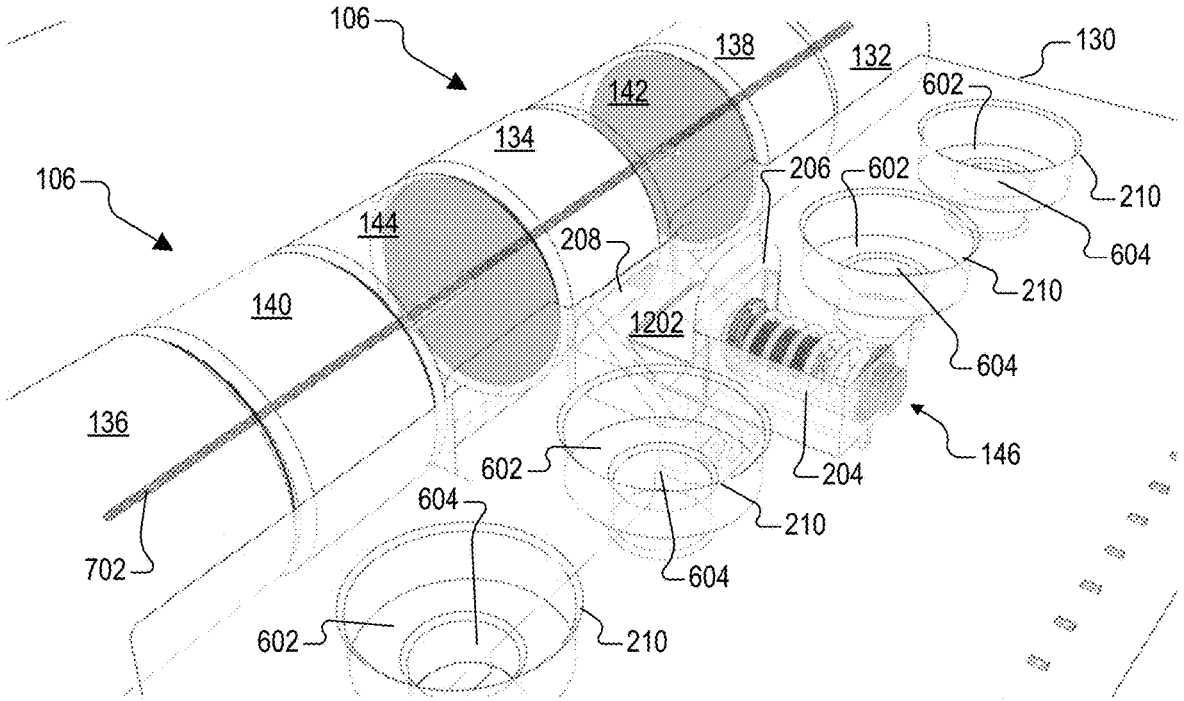
FIG. 7 is a closeup rear perspective view in phantom looking downwards from an elevated position illustrating further details of a hinge assembly and the tabletop according to one embodiment of the present disclosure.

FIG. 7 is a closeup rear perspective view in phantom looking downwards from an elevated position illustrating further details of the hinge assembly 106 and the tabletop 130 according to one embodiment of the present disclosure. The tabletop 130 is shown in its opened position. The hinge assembly 106 includes an internally installed hinge bar 702 that extends through center holes (e.g., hole 906 shown in FIG. 9) of the inner surfaces of the left hinge 132 and the right hinge 136 of the main body 102, through a center hole 908 (FIG. 9) of the middle hinge 134 of the main body 102, and through center holes 1002 and 1004 (FIG. 10) of the lid hinges 138 and 140 and through center holes 1102 and 1104 (FIG. 11) of the tabletop hinges 142 and 144. In this manner, the lid 104 and the tabletop 130 may be pivoted or rotated relative to a common axis formed by the hinge bar 702. The hinge bar 702 may be made of a suitable metallic material such as aluminum or steel or the like.

Additional details of the tabletop latch 146 are shown in FIG. 7 including the latch spring 204 and the latch handle 206. The tabletop latch 146 is shown in its locked position in which the locking extension 1202 is inserted into the slot 208 formed in the body of the middle hinge 134 to lock the tabletop 130 into its opened position.

The cupholders 210 are shown extending into the body of the tabletop 130 to the bottom surfaces 602, and the holes 604 are shown extending from corresponding bottom surfaces 602 to the lower surface 804 (FIG. 8) of the tabletop 130. In one embodiment, the cupholders 210 have a diameter that is larger than and yet concentric with the smaller diameters of the holes 604.

Figure 8:
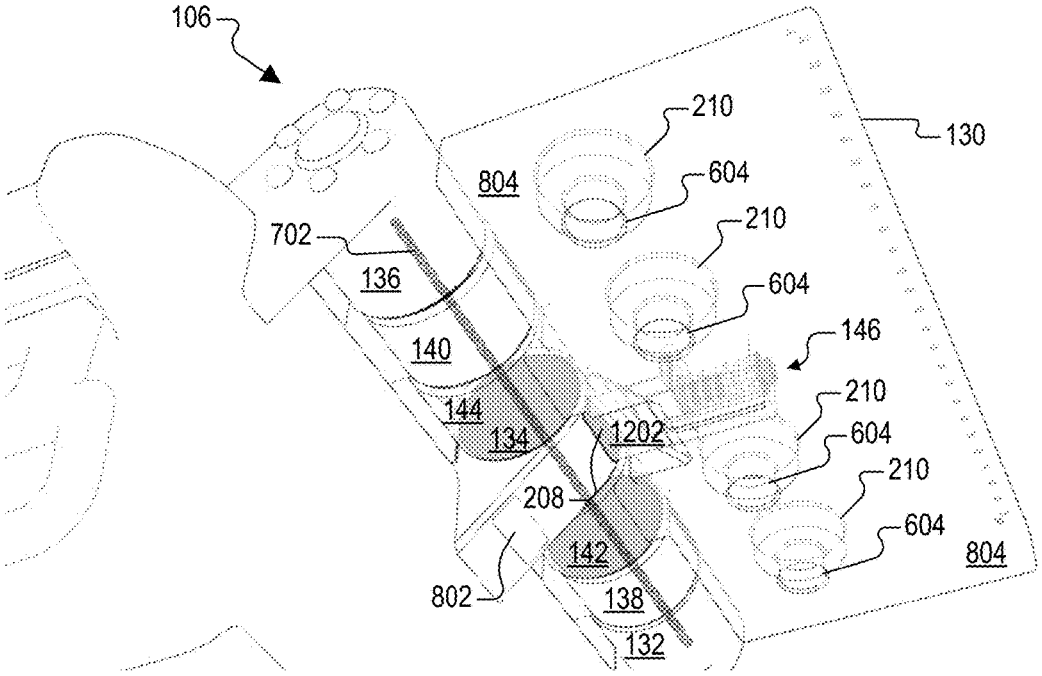
FIG. 8 is a closeup rear perspective view in phantom looking upwards from a lower position illustrating further details of the hinge assembly and the tabletop according to one embodiment of the present disclosure.

FIG. 8 is a closeup rear perspective view in phantom looking upwards from a lower position illustrating further details of the hinge assembly 106 and the tabletop 130 according to one embodiment of the present disclosure. Again, the tabletop 130 is shown in its opened position. The hinge assembly 106 is shown including the hinge bar 702 internally extending between the left hinge 132 and the right hinge 136 and extending through center holes of each of the remaining hinges 134, 138, 140, 142, and 144 as previously described. The tabletop latch 146 is in its locked position with the locking extension 1202 inserted into the slot 208 similar to that shown in FIG. 7. The body of the middle hinge 134 further includes a lower slot 802 for receiving the locking extension 1202 when the tabletop 130 is lowered and locked into its closed position. The cupholders 210 with the smaller center holes 604 are also shown, in which each hole 604 extends all the way to the lower surface 804 of the tabletop 130.

Figure 9:
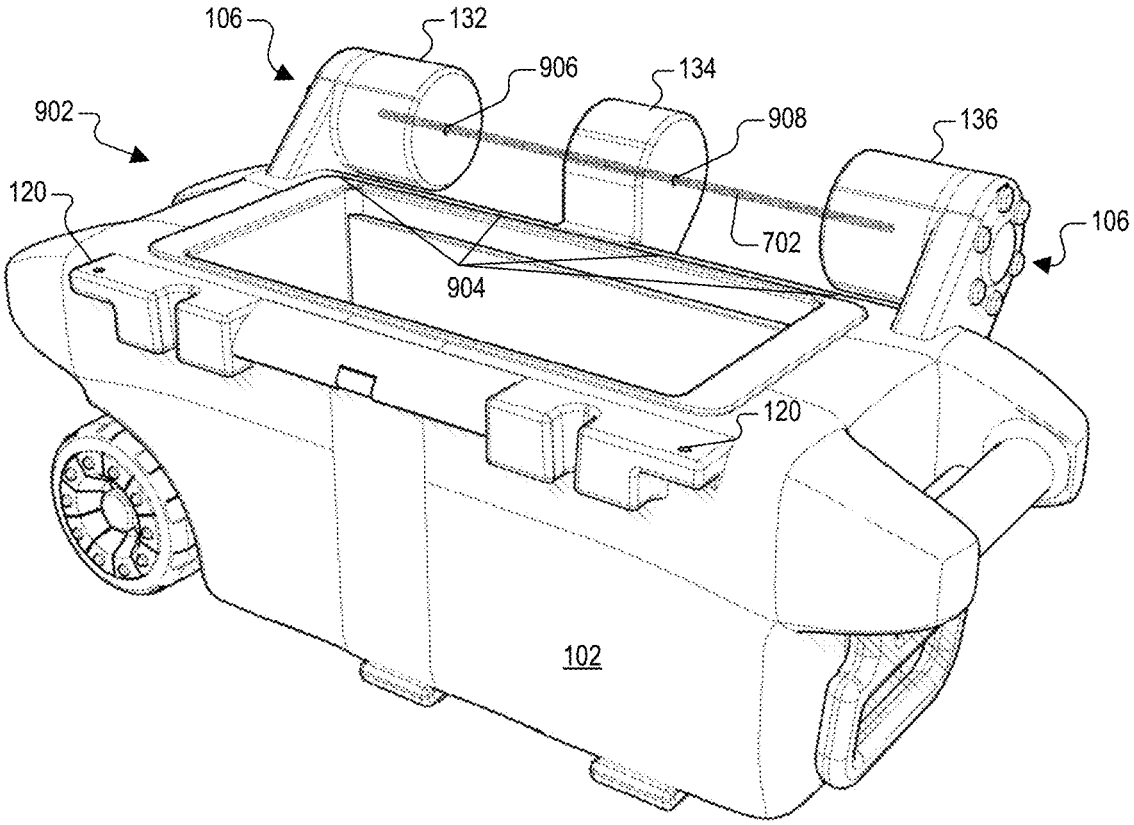
FIG. 9 is a front perspective view of the main body of the cooler of FIG. 1 with the lid and the tabletop removed and a hinge bar shown in phantom according to one embodiment of the present disclosure.

FIG. 9 is a front perspective view of the main body 102 of the cooler 100 with the lid 104 and the tabletop 130 removed and the hinge bar 702 shown in phantom according to one embodiment of the present disclosure. An upper or top area of the main body 102 includes the upper circumference 902 with the back edge 904. The left, middle, and right hinges 132, 134, and 136, respectively, are mounted to or otherwise integrally formed with the main body 102 along the back edge 904. The cylindrically-shaped left hinge 132 includes an inner circular surface with the hole 906 for receiving one end of the hinge bar 702. The cylindrically-shaped right hinge 136 also includes an inner circular surface with a hole (not shown in FIG. 9) for receiving an opposite end of the hinge bar 702. The cylindrically-shaped middle hinge 134 also includes circular surfaces with the center hole 908 that extends through middle hinge 134 for receiving a supporting the hinge bar 702.

Figure 10:
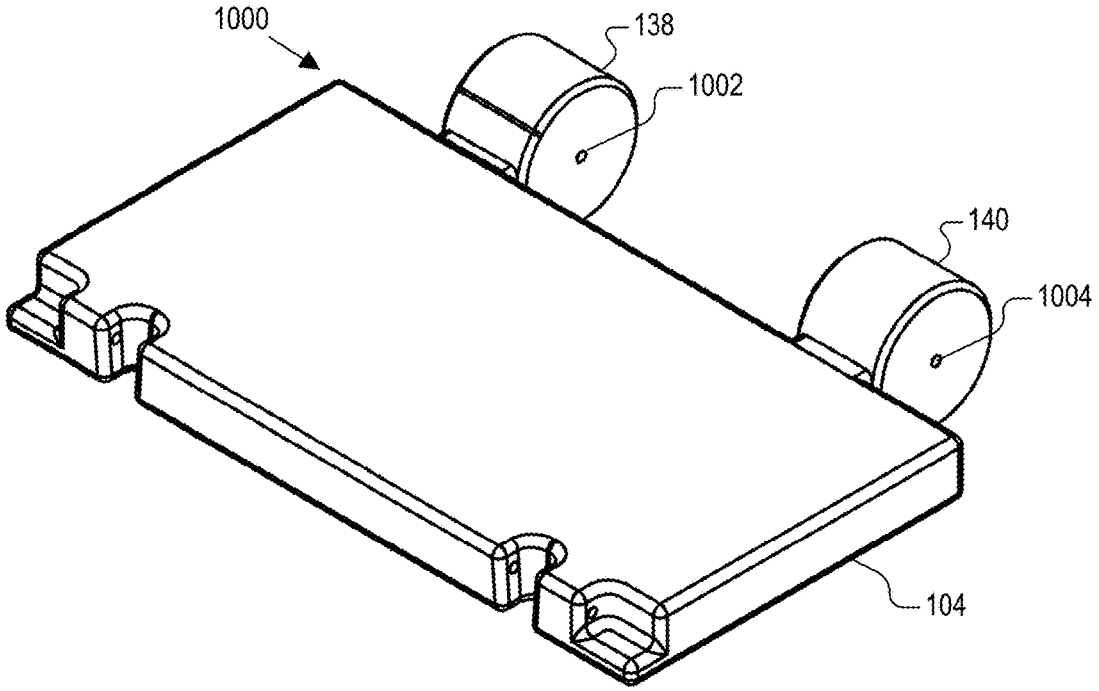
FIG. 10 is a perspective view of the lid with hinges implemented according to one embodiment of the present disclosure.

FIG. 10 is a perspective view of the lid 104 with its hinges 138 and 140 implemented according to one embodiment of the present disclosure. In the illustrated embodiment, the lid 104 generally has the shape of a rectangular parallelepiped, although alternative shapes and forms are contemplated. The cylindrically-shaped hinges 138 and 140 are mounted to or otherwise integrally formed along a back edge 1000 of the lid 104. Each of the hinges 138 and 140 includes circular surfaces on either side with center holes 1002 and 1004, respectively, in the center of the cylindrically-shaped bodies of the hinges for receiving and supporting the hinge bar 702.

Figure 11:
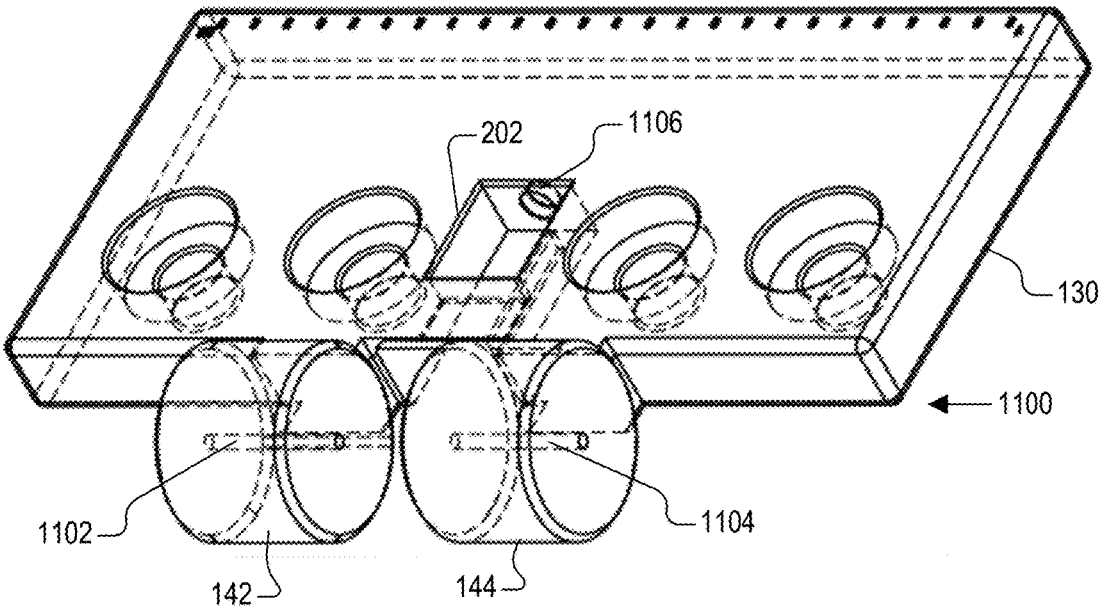
FIG. 11 is a perspective view of the tabletop in phantom with hinges implemented according to one embodiment of the present disclosure.

FIG. 11 is a perspective view of the tabletop 130 in phantom with its hinges 142 and 144 implemented according to one embodiment of the present disclosure. In the illustrated embodiment, the tabletop 130 also generally has the shape of a rectangular parallelepiped, although alternative shapes and forms are contemplated. The cylindrically-shaped hinges 142 and 144 are mounted to or otherwise integrally formed along a front edge 1100 of the tabletop 130. Each of the hinges 142 and 144 includes center holes 1102 and 1104, respectively, for receiving and supporting the hinge bar 702. The opening 202 within the tabletop 130 includes a threaded hole 1106 for installing the tabletop latch 146 as further described herein.

Figure 12:
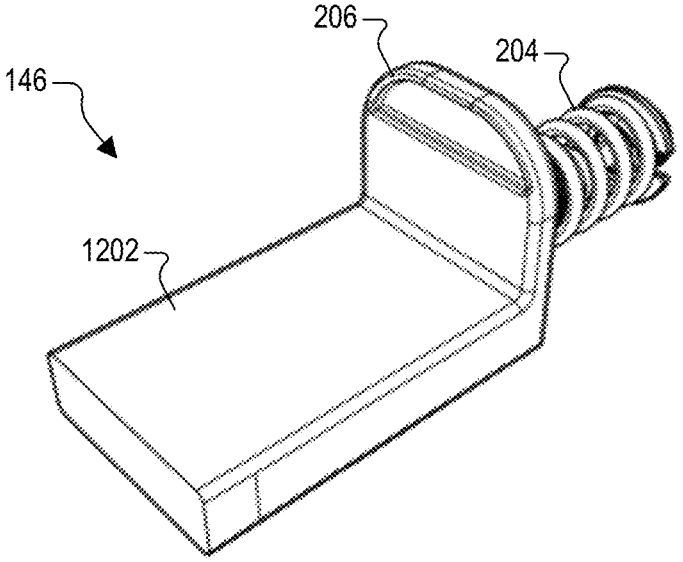
FIG. 12 is a perspective view of a tabletop latch implemented according to one embodiment of the present disclosure.

FIG. 12 is a perspective view of the tabletop latch 146 implemented according to one embodiment of the present disclosure. The tabletop latch 146 includes the latch handle 206 integrally formed with the locking extension 1202 forming an L-shaped structure. The latch spring 204 is positioned on the other side of the latch handle 206 relative to the locking extension 1202.

Figure 13:
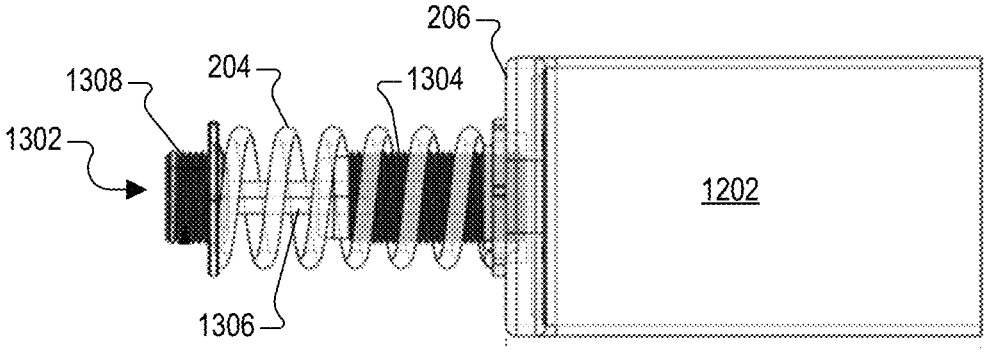
FIG. 13 is an orthogonal top view and FIG. 14 is a corresponding orthogonal side view of the tabletop latch implemented according to one embodiment of the present disclosure.
Figure 14:
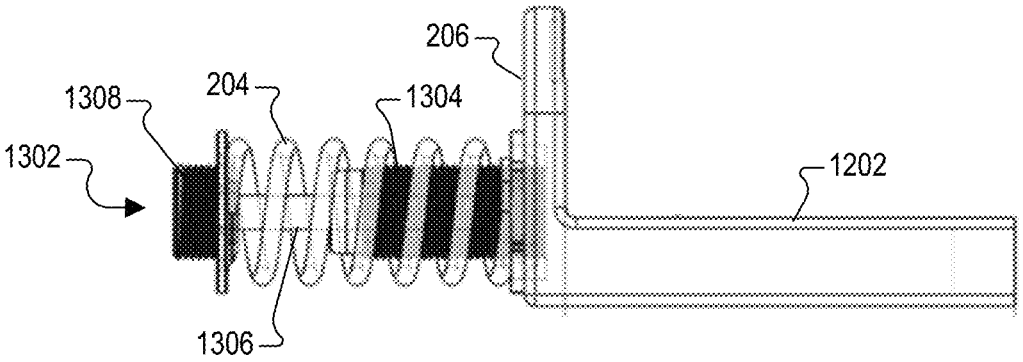

FIG. 13 is an orthogonal top view and FIG. 14 is a corresponding orthogonal side view of the tabletop latch 146 implemented according to one embodiment of the present disclosure. The tabletop latch 146 includes a plunger assembly 1302 mounted on the backside of the latch handle 206 opposite the locking extension 1202. The plunger assembly 1302 includes a threaded base section 1304 that may be screwed into a threaded portion on the backside of the latch handle 206, a plunger rod 1306 having one end inserted into the base section 1304, and a threaded latch cap 1308 mounted on the other end of the plunger rod 1306. The plunger rod 1306 is configured to move into and out of an internal portion of the base section 1304 to enable the tabletop latch 146 to be moved between the locked and unlocked positions. The latch spring 204 has a hollow center section which is inserted over and around the base section 1304 and the plunger rod 1306 as shown. The latch spring 204 is positioned between the latch handle 206 and the latch cap 1308 and is shown in its resting position when the tabletop latch 146 is locked.

The tabletop latch 146 is installed by being inserted into the opening 202 of the tabletop 130 with the locking extension 1202 inserted into an internal slot to extend through an opening between the tabletop hinges 142 and 144. The latch cap 1308 is screwed into the threaded hole 1106 (FIG. 11) within the opening 202 of the tabletop 130 to secure it in place. In operation, the latch handle 206 is slid towards the threaded hole 1106 to pull the locking extension 1202 into the body of the tabletop 130 while compressing the spring 204 for the unlocked position. The tabletop 130 may then be pivoted between its closed and opened positions. When the tabletop 130 is in its closed position, the latch handle 206 is released so that the spring 204 pushes the locking extension 1202 into the lower slot 802 formed within the center hinge 134 so that the tabletop 130 is locked in place in its closed position. When in the opened position, the latch handle 206 is released so that the spring 204 pushes the locking extension 1202 into the upper slot 208 formed within the center hinge 134 so that the tabletop 130 is locked in place in its opened position.

Figure 15:
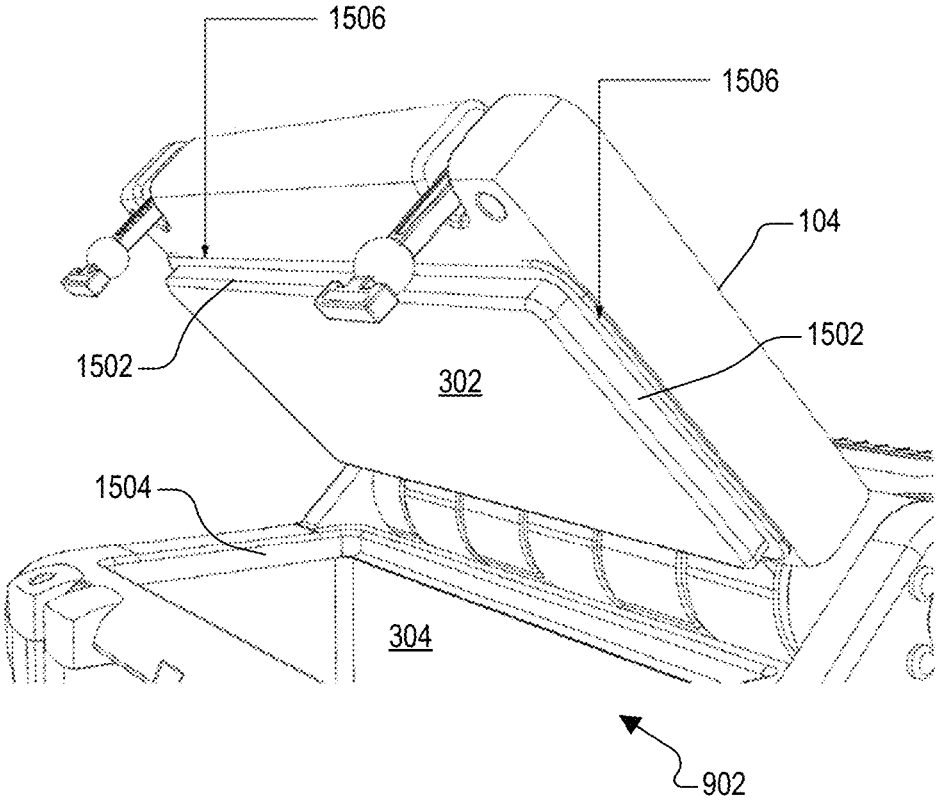
FIG. 15 is a close-up view of a lower surface of the lid configured according to one embodiment of the present disclosure.

FIG. 15 is a close-up view of the lower surface 302 of the lid 104 configured according to one embodiment of the present disclosure. The lower surface 302 of the lid 104 includes an extended portion 1502 that inserts into the upper circumference 902 of the main body 102 to interface with a lip 1504 formed along an interior portion of the upper circumference 902 when the lid 104 is in the closed position. A gasket 1506 may be installed or otherwise formed around a circumference of the extended portion 1502 of the lower surface 302 of the lid 104 to interface with the lip 1504 when the lid 104 is in the closed position. The interfacing between the gasket 1506 and the lip 1504 form an air-lock gasket seal that creates a seal enclosing the interior cavity 304.

The present description has been presented to enable one of ordinary skill in the art to make and use the present invention as provided within the context of particular applications and corresponding requirements. The present invention is not intended, however, to be limited to the particular embodiments shown and described herein, but is to be accorded the widest scope consistent with the principles and novel features herein disclosed. Many other versions and variations are possible and contemplated. Those skilled in the art should appreciate that they can readily use the disclosed conception and specific embodiments as a basis for designing or modifying other structures for providing the same purposes of the present invention without departing from the spirit and scope of the invention.

The invention claimed is:

1. A cooler, comprising:

a main body comprising an interior cavity and an upper circumference when the main body is in an upright position;

a lid pivotally attached to the main body having a closed position for covering the upper circumference of the main body to enclose the interior cavity forming an insulating container; and a tabletop pivotally attached to the main body with a hinge assembly and having an opened position to form a horizontal surface for placing and supporting objects when the main body is in the upright position, wherein the tabletop comprises a latch structure that interfaces the hinge assembly to lock the tabletop in place in the opened position.

2. The cooler of claim 1, wherein the tabletop has a vertical stored position adjacent a back wall of the main body.

3. The cooler of claim 1, further comprising:

a hinge assembly mounted to at least a portion of the upper circumference; and wherein the lid and the tabletop are both pivotally attached to the main body at the hinge assembly.

4. The cooler of claim 3, further comprising:

the upper circumference of the main body having a rectangular shape with a back edge; and wherein the hinge assembly is mounted along the back edge of the upper circumference.

5. The cooler of claim 4, wherein the hinge assembly comprises:

left and right hinges integrally mounted on either end of the back edge and a middle hinge integrally mounted along the back edge between and aligned with the left and right hinges;

the lid comprising a first rectangular parallelepiped structure having at least one hinge integrally mounted along a side edge of the first rectangular parallelepiped structure;

the tabletop comprising a second rectangular parallelepiped structure having at least one hinge integrally mounted along a side edge of the second rectangular parallelepiped structure;

wherein the at least one hinge of the lid and the at least one hinge of the tabletop are aligned with the left and right hinges and the middle hinge of the main body; and a hinge bar inserted through a center of each of the at least one hinge of the lid, through a center of each of the at least one hinge of the tabletop, and through a center of the middle hinge, and that extends into each of the left and right hinges.

6. The cooler of claim 5, wherein:

the middle hinge comprises a cylindrical structure with a circular outer surface including a first slot corresponding to the closed position of the tabletop and a second slot corresponding to an opened position of the tabletop; and wherein the latch structure is formed within an opening of the second rectangular parallelepiped structure of the tabletop for interfacing either the first slot or the second slot when the second rectangular parallelepiped structure is moved to either the closed position or the opened position, respectively.

7. The cooler of claim 6, wherein the latch structure comprises a spring-loaded latch having a locking extension that protrudes from an edge of the second rectangular parallelepiped structure of the tabletop in a locked position and that is withdrawn within a body of the second rectangular parallelepiped structure of the tabletop in an unlocked position, and wherein the extension inserts within the first slot when the latch is in the locked position and the tabletop is in the closed position, or wherein the extension inserts within the second slot when the latch is in the locked position and the tabletop is in the opened position.

8. The cooler of claim 1, wherein the tabletop further comprises at least one cupholder formed along an upper surface of the tabletop.

9. The cooler of claim 1, wherein the tabletop further comprises at least one hole between upper and lower surfaces of the tabletop, each of the at least one hole for receiving a supporting a pole.

10. The cooler of claim 1, wherein a lower surface of the lid comprises an extended portion that inserts into the upper circumference of the main body to interface a lip formed along an interior portion of the upper circumference when the lid is in the closed position.

11. The cooler of claim 10, further comprising a gasket provided around a circumference of the extended portion of the lid to form an air-lock gasket seal for the interior cavity when the lid is in the closed position.

12. The cooler of claim 1, further comprising a towing handle and at least one wheel mounted to the main body for towing.

13. The cooler of claim 1, further comprising at least one slot formed on the main body and at least one lid lock mounted to the lid for locking the lid to the main body in the closed position.

14. The cooler of claim 1, further comprising at least one structural footing mounted on a lower end of the main body designed to support heavy loads.

15. The cooler of claim 1, further comprising a bottle opener mounted to the main body.

16. The cooler of claim 1, further comprising at least one handle integrally formed on an upper portion of the main body.

17. The cooler of claim 1, further comprising a drain hole formed in the main body for receiving a drain plug.

18. The cooler of claim 1, further comprising a pressure release valve mounted to the main body.

19. A cooler, comprising:

a main body comprising an interior cavity and an upper circumference when the main body is in an upright position;

a lid pivotally attached to the main body by a hinge assembly, wherein the lid has a closed position for covering the upper circumference of the main body to enclose the interior cavity forming an insulating container; and a tabletop pivotally attached to the main body by the hinge assembly, wherein the tabletop has an opened position to form a horizontal surface for placing and supporting objects when the main body is in the upright position, and wherein the tabletop comprises a latch structure that interfaces the hinge assembly to lock the tabletop in place in the opened position.

20. The cooler of claim 19, wherein the tabletop has a closed position and wherein the latch structure locks the tabletop in place in the closed position.

* * * * *